US007694641B2

(12) United States Patent
Lockhart

(10) Patent No.: US 7,694,641 B2
(45) Date of Patent: Apr. 13, 2010

(54) SNOW MARKER FOR FIRE HYDRANTS AND OTHER UTILITIES

(76) Inventor: Earl Robert Lockhart, 9 - 33179 Ferguson Way, Abbotsford, BC (CA) V2S 2L6

( * ) Notice: Subject to any disclaimer, the term of this patent is extended or adjusted under 35 U.S.C. 154(b) by 0 days.

(21) Appl. No.: 12/233,007

(22) Filed: Sep. 18, 2008

(65) Prior Publication Data

US 2010/0064563 A1 Mar. 18, 2010

(51) Int. Cl.
*G09F 17/00* (2006.01)

(52) U.S. Cl. ..... 116/209; 116/173; 40/607.1; 248/539

(58) Field of Classification Search ..... 116/209, 116/173–175, 63 R, 63 P; 40/307.11, 590, 40/591, 606.01, 607.01, 607.1, 607.11, 607.12, 40/612, 660; 248/684, 534, 538
See application file for complete search history.

(56) References Cited

U.S. PATENT DOCUMENTS 2,199,897 A * 5/1940 Stringer ..... 52/152
2,237,536 A * 4/1941 Wells, Jr ..... 340/321
2,249,848 A 7/1941 O'Brien
2,424,269 A * 7/1947 Doody ..... 248/475.1
2,775,221 A * 12/1956 Olson ..... 116/173
3,044,435 A 7/1962 Reardon
3,812,815 A * 5/1974 Kuenzel ..... 116/28 R
4,478,169 A 10/1984 Shrefler
4,779,955 A * 10/1988 Schmanski ..... 359/552
4,908,249 A 3/1990 Lines
5,033,501 A 7/1991 Stehling
5,520,141 A 5/1996 Lutz
5,588,630 A * 12/1996 Chen-Chao ..... 248/514
5,664,597 A * 9/1997 Miskiewicz ..... 137/15.02
6,890,122 B1 * 5/2005 Nielsen ..... 404/10
6,935,360 B2 * 8/2005 Knappmiller ..... 137/296

* cited by examiner

*Primary Examiner*—Amy Cohen Johnson
(74) *Attorney, Agent, or Firm*—Bruce M. Green; Oyen Wiggs Green & Mutala

(57) ABSTRACT

The invention provides marking apparatus for a fire hydrant or other utilities fixtures comprising a mast-holding bracket comprising a hollow pipe, means for removably securing the pipe to the fire hydrant or other utilities fixtures and an elongated mast removably received in the hollow pipe, the mast comprising a solid cylindrical flexible core and a flexible outer shell for mounting on the core, further comprising fastening means for securing the mast to the pipe. The apparatus can be attached to the outlet of a fire hydrant, the hole for the lifting bolt of a transformer or to a junction box, or as part of a concrete pedestal.

10 Claims, 9 Drawing Sheets

SNOW MARKER FOR FIRE HYDRANTS AND OTHER UTILITIES

TECHNICAL FIELD

The invention relates to markers for marking the location of fire hydrants, electrical utility or other utilities fixtures which may become buried under a snow cover.

BACKGROUND

In climates where there is significant snowfall, it is important to be able to locate important utilities such as fire hydrants which become buried in snow. Various devices are used to mark such utilities with something which will be visible above the snow. Examples of such devices are shown in U.S. Pat. Nos. 3,044,435; 4,478,169; and 4,908,249. These may involve an elongated mast, flag or pole which is secured to the hydrant flange. Due to the attachment to the hydrant flange, the mast, flag or pole must be pivotable or bendable so it can be moved out of the way to attach a hose to the hydrant. Some devices have the mast mounted on a fixed bracket which pivots and others are spring mounted, which reduces the durability of the device and adds cost. Further such devices are not readily adaptable to other types of utilities such as junction boxes and transformers.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

The invention provides a marking apparatus for a fire hydrant or other utilities fixtures comprising a mast-holding bracket comprising a hollow pipe, means for removably securing the pipe to the fire hydrant or other utilities fixtures and an elongated mast removably received in the hollow pipe, the mast comprising a solid cylindrical flexible core and a flexible outer shell for mounting on the core, further comprising fastening means for securing the mast to the pipe. The apparatus can be attached to the outlet of a fire hydrant, the hole for the lifting bolt or bracket of a transformer or to a junction box, or as part of a concrete pedestal.

In addition to the exemplary aspects and embodiments described above, further aspects and embodiments will become apparent by reference to the drawings and by study of the following detailed descriptions.

BRIEF DESCRIPTION OF DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1:
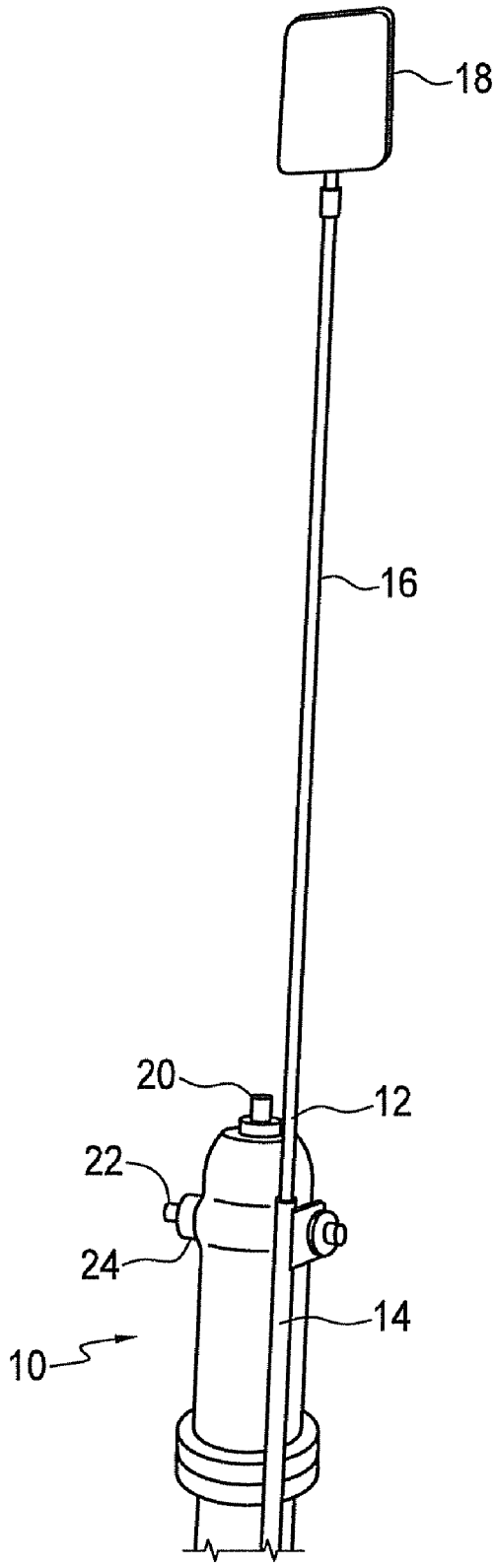
FIG. 1 is a perspective view of the invention attached to a fire hydrant.
Figure 2A:
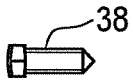
FIG. 2A is a detail elevation of the piercing bolt for the holder bracket assembly.
Figure 2B:
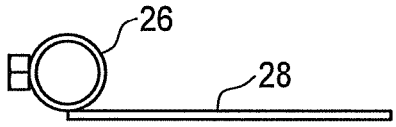
FIG. 2B is a top view of the holder bracket assembly shown in FIG. 2C.
Figure 2C:
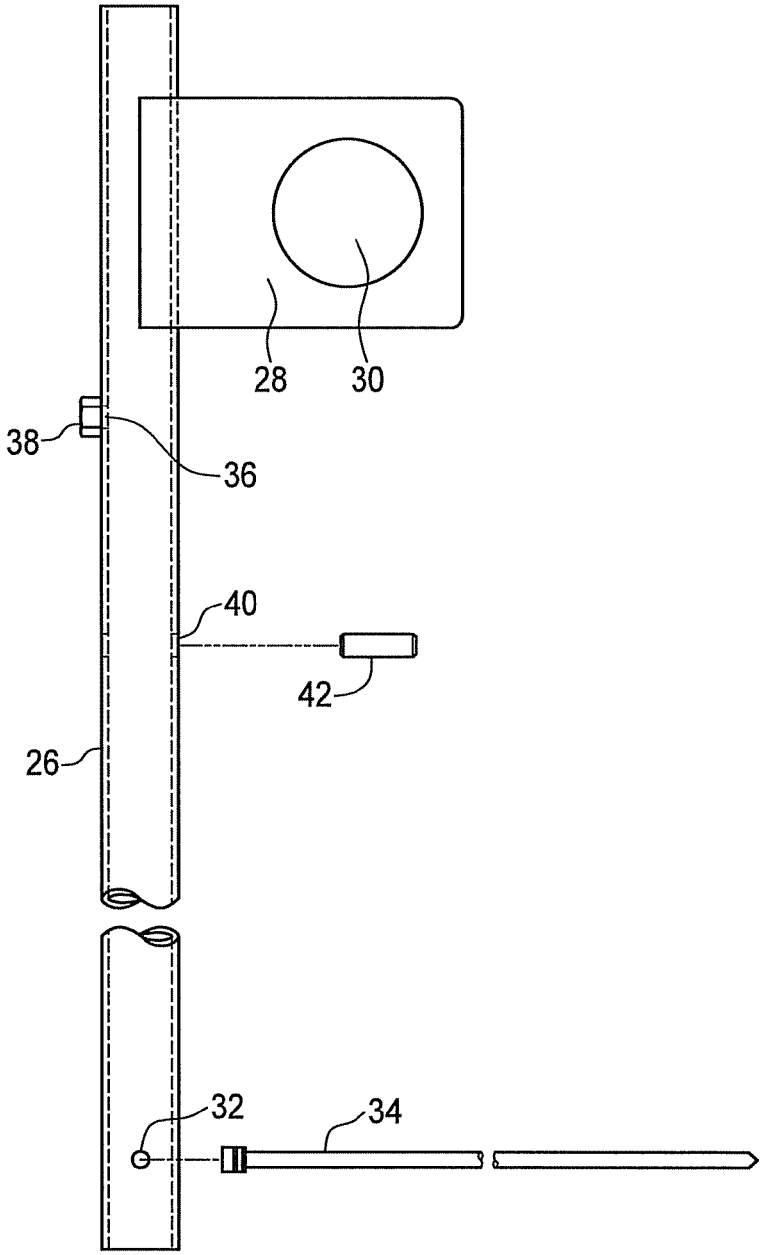
FIG. 2C is a detail elevation, broken away of the holder bracket assembly.
Figure 3:
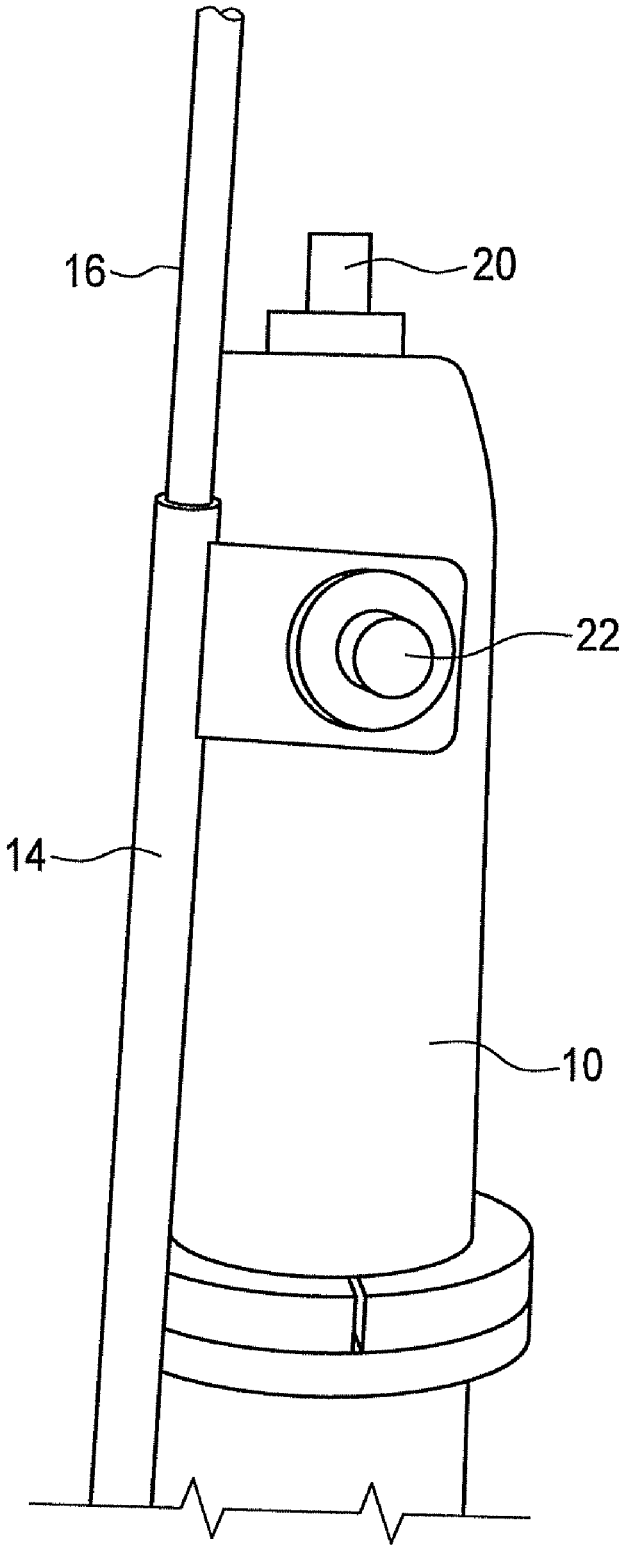
FIG. 3 is a detail perspective view of the invention attached to a fire hydrant.
Figure 4:
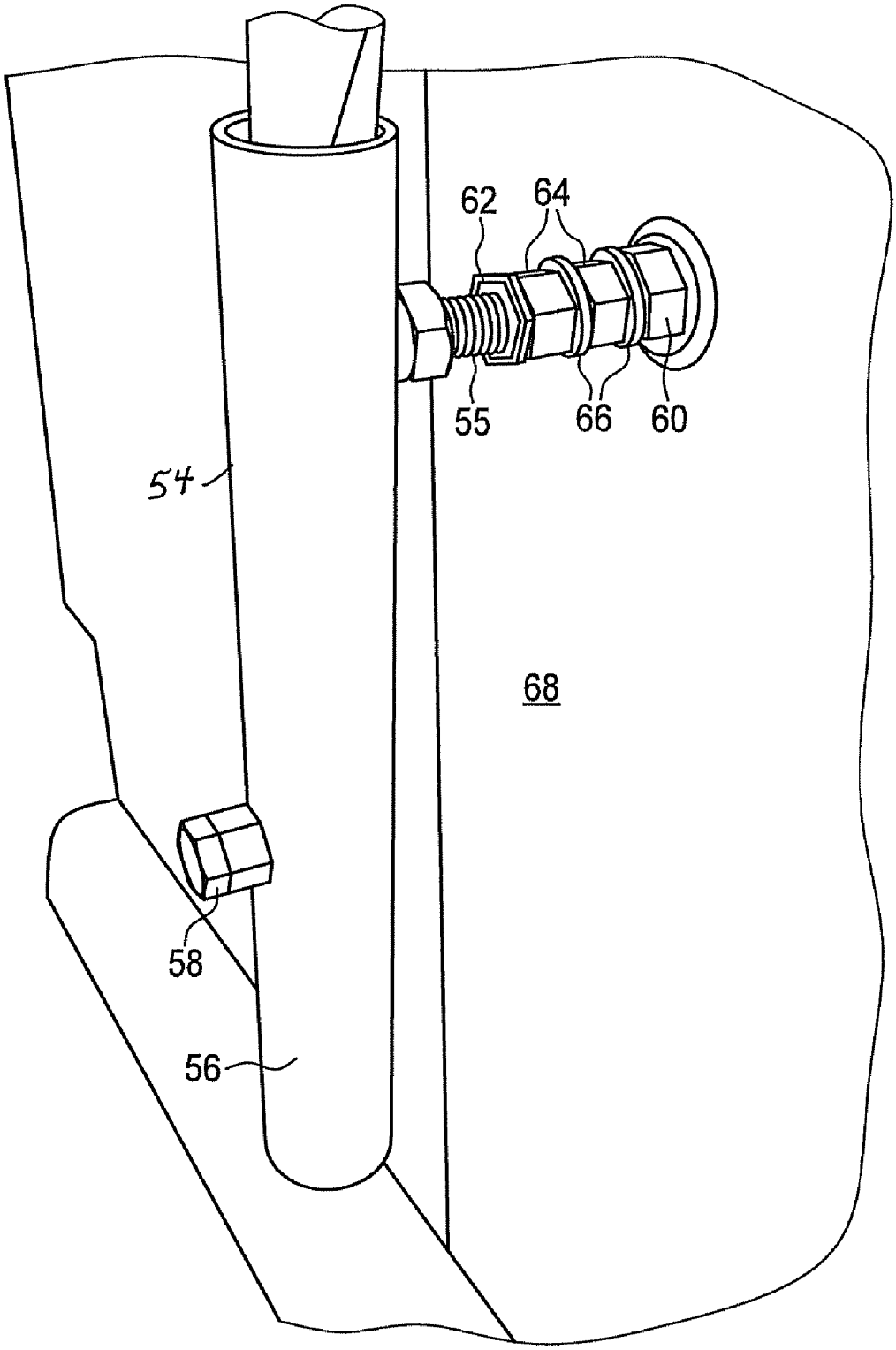
FIG. 4 is a perspective view of a variation of the holder bracket assembly invention for attachment to a transformer box for a Low Profile Transformer (LPT) or a Pad Mounted Transformer (PMT).
Figure 5A:
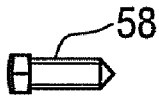
FIG. 5A is a detail elevation of the piercing bolt for the holder bracket assembly shown in FIG. 4.
Figure 5B:
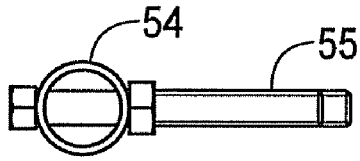
FIG. 5B is a top view of the holder bracket assembly shown in FIG. 4.
Figure 5C:
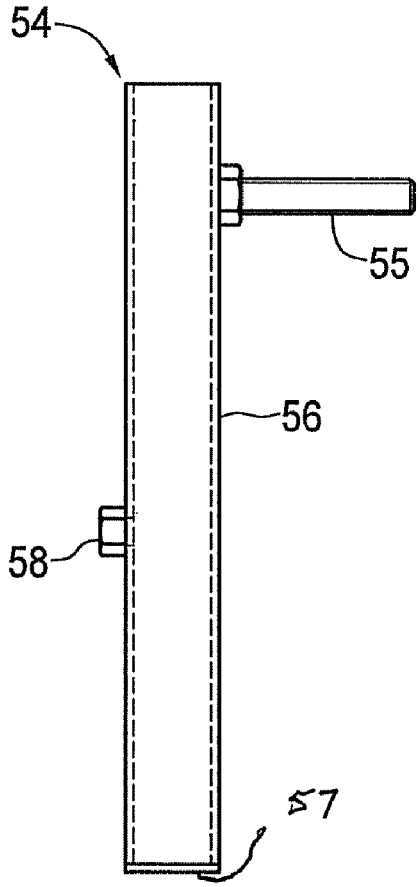
FIG. 5C is an elevation view of the variation of the holder bracket shown in FIG. 4.
Figure 6A:
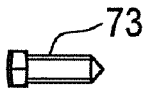
FIG. 6A is a detail elevation of the piercing bolt for the holder bracket assembly shown in FIG. 6C.
Figure 6B:
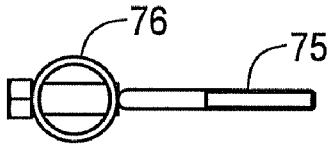
FIG. 6B is a top view of the holder bracket assembly shown in FIG. 6C.
Figure 6C:
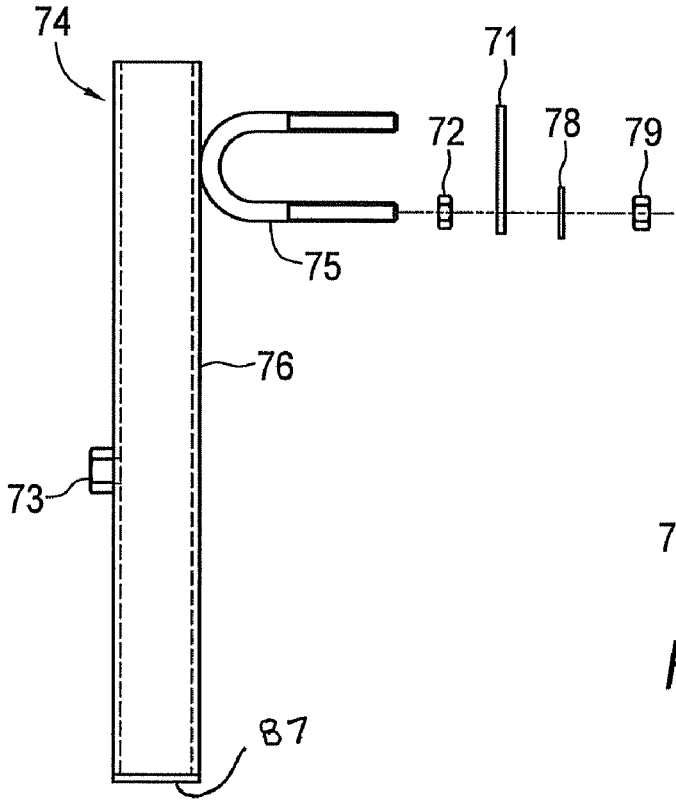
FIG. 6C is an elevation view of a further variation of the holder bracket assembly invention for attachment to a transformer box for a Pad Mounted Transformer (PMT).
Figure 6D:
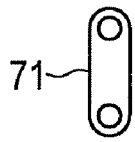
FIG. 6D is a detail elevation of the flat bar for the holder bracket assembly shown in FIG. 6C.
Figure 7:
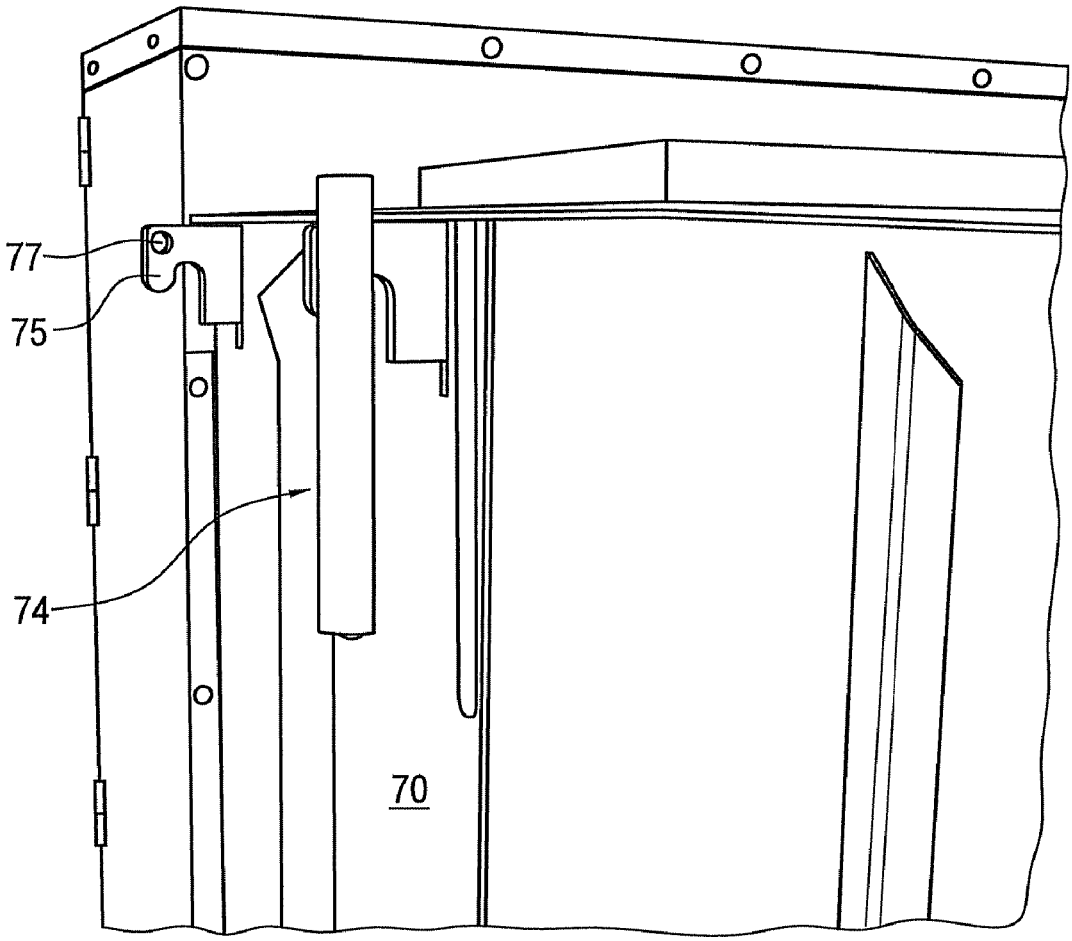
FIG. 7 is a perspective view of the variation of the holder bracket shown in FIG. 6C installed on a transformer box.

With reference to FIGS. 1 to 3, a fire hydrant 10 is provided with a snow marker 12, comprising a mast-holding bracket 14, mast 16 and sign 18. Fire hydrant 10 typically has a nut 20 for opening and closing the valve and a cap 22 which has screw threads for attaching to threaded outlet 24 for attaching the fire hose. Mast-holding bracket 14 (FIG. 2) comprises a hollow cylindrical steel pipe or tube 26 to which is welded a rectangular steel plate 28 having an aperture 30 sized to fit over outlet 24. Pipe 26 has a hole 32 extending completely through it adjacent its lower end, for receiving a nylon strap 34. Pipe 26 also has a hole 40 extending completely through it for receiving a pin 42 which is inserted into hole 40 and both ends of pin 42 are welded to pipe 26 to provide a lower stop for mast 16. Pipe 26 also has a threaded hole 36 in one side for receiving a threaded piercing bolt 38 extending completely through it adjacent its lower end.

Figure 10A:
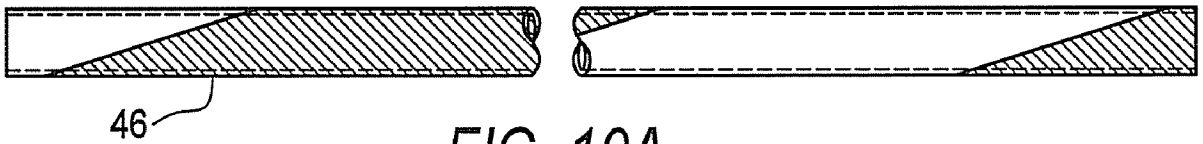
FIG. 10A is a detail elevation, broken away of the exterior shell for the mast assembly.
Figure 10B:
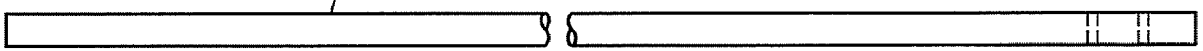
FIG. 10B is a detail elevation, broken away of the pultrusion rod for the mast assembly.
Figure 10C:
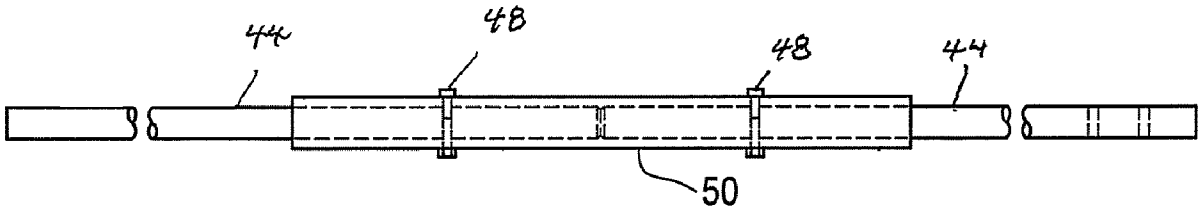
FIG. 10C is a detail elevation, broken away of the mast assembly.

The construction of mast 16 is shown in further detail in FIG. 10A-C. It comprises a solid fiberglass pultrusion rod 44 as the core of the mast and a hollow brightly colored exterior shell 46 which surrounds rod 44. Rod 44 is flexible and returns to its original shape when bent or pushed over. The use of a solid fiberglass pultrusion has the advantage that should the rod be vandalized to the point of breaking, it will splinter into soft fibers and so will not cause injury if a person comes into contact with it. Preferably the mast is about 16 feet in length, and may be formed as shown in FIG. 10C from two 8-foot long fiberglass rods joined by a coupling tube 50 and bolts 48 which fasten the coupling tube through drilled holes in rods 44. Sign 18 may be an aluminum sheet which is bolted to the rod 44 with a reflective decal adhered to both sides. The exterior shell 46 may be a plastic with bright yellow and red stripes. Shell 46 slides over the fiberglass rod 44 and is secured by piercing bolt 38 when installed in pipe 26.

To install the device on hydrant 10, cap 22 is removed from outlet 24 and it is insured that there is sufficient exposure of the hydrant 10 between the ground and the outlet to receive the mast-holding bracket 14. Aperture 30 of the mast-holding bracket 14 is then placed over outlet 24 and the cap 22 replaced and tightly screwed into place while ensuring the mast-holding bracket 14 is vertical. Where the bottom of the fire hydrant is exposed above the soil, nylon strap 34 is extended through hole 32 in the mast-holding bracket 14 and extended around the fire hydrant and tightened snugly to maintain the mast-holding bracket 14 in position. Sign 18 is then bolted to the top of rod 44 and tube 46 slid over rod 44 until it is stopped by sign 18. A tie strap (not shown) can be installed through holes near the top of tube 46 to prevent the spiral marker from separating. The lower end of the combined rod 44, tube 46 and sign 18 assembly is then lowered into the mast-holding bracket 14 and piercing bolt 38 tightened until it pierces into rod 44.

FIGS. 4 and 5A-C illustrate a variation of the holder bracket assembly 54 for attachment to a transformer box 68. Mast-holding bracket 54 in this case comprises a hollow cylindrical steel pipe or tube 56 to which is welded a hex head bolt 55 and having a stop plate 57 welded to the bottom of the pipe. Bolt 55 is screwed into the threaded hole 60 in the transformer box which receives the transformer lifting bolt. A pal nut 62 and two nuts 64 and lock washers 66 (FIG. 4) are threaded onto the end of bolt 55 prior to threading it into the threaded hole 60 in the transformer box. The mast-holding bracket 54 is rotated until tight, then backed off to the vertical position before tightening nuts 62, 64. The mast 16 is then installed as above.

FIGS. 6A-D and 7 illustrate a variation of the holder bracket assembly 74 for attachment to a transformer box 70. Mast-holding bracket 74 in this case comprises a hollow cylindrical steel pipe or tube 76 to which is welded a U-bolt 75 and having a stop plate 87 welded to the bottom of the pipe. U-bolt 75 is fastened to a transformer lifting bracket 77 by means of a hex jam nut 72, flat bar 71, flat washer 78 and hex nut 79. The mast-holding bracket 74 is tightened in the vertical position. The mast 16 is then installed as above and piercing bolt 73 in inserted.

Figure 8:
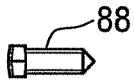
FIG. 8 is a detail elevation of the piercing bolt for the holder bracket assembly shown in FIG. 9B.
Figure 9A:
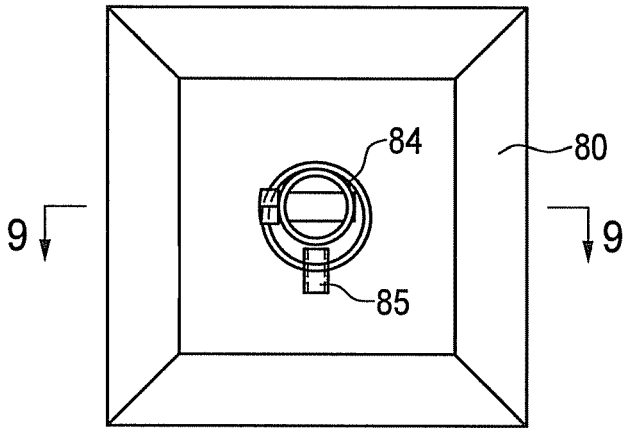
FIG. 9A is a top view of a variation of a junction box holder bracket assembly invention for attachment to a concrete plinth.
Figure 9B:
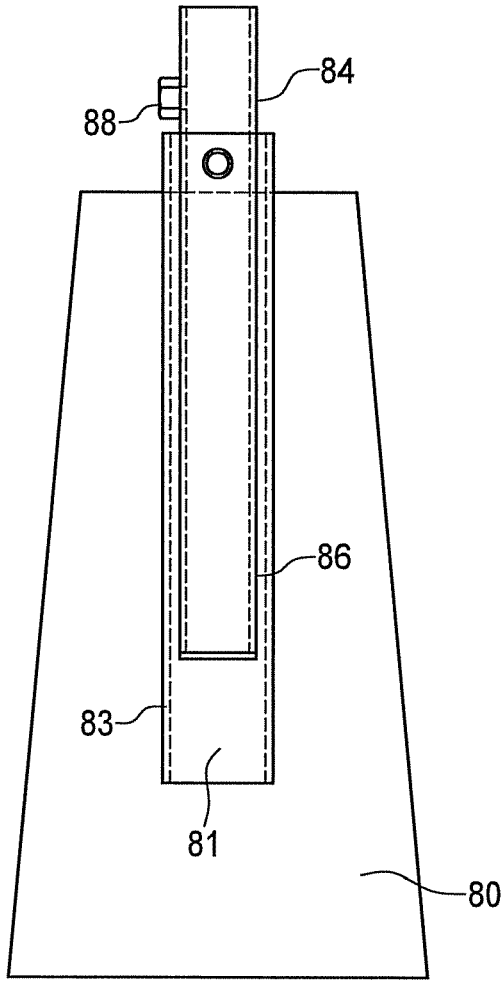
FIG. 9B is a cross-sectional view of the variation of the junction box holder bracket assembly invention taken along lines 9-9 of FIG. 9A.

FIGS. 8 and 9A-B illustrate a variation of the holder bracket assembly 84 for attachment to a pre-cast concrete pedestal 80 to form a ground vault. Pre-cast concrete pedestal 80 is formed as a concrete pyramid with a central hollow cylindrical chamber 81 for receiving a steel pipe 83. Mast-holding bracket 84 in this case comprises a hollow cylindrical steel pipe or tube 86, welded closed at the lower end, which is fastened to pipe 83 by a bolt 85. Bolt 85 is screwed through holes in pipes 83 and 86. The mast 16 is then installed as above and secured by tightening piercing bolt 88.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A marking apparatus for marking the location of a fire hydrant or other utilities fixtures buried under a layer of snow on an outdoor surface, comprising a mast-holding bracket comprising a hollow pipe, means for removably securing said pipe to said fire hydrant or other utilities fixtures and an elongated mast removably received in said hollow pipe, said mast extending generally vertically upwardly from said fire hydrant or other utilities fixture when so received in said hollow pipe and comprising a solid cylindrical flexible core, indicator means secured adjacent the upper end of said core for indicating said location and a flexible plastic cylindrical outer shell for slidably mounting coaxially on the core, further comprising fastening means for securing said mast to said pipe; wherein said mast has a length whereby said indicator means is located above said snow layer when said mast is so received in said hollow pipe and wherein said fastening means for securing said mast to said pipe comprises piercing means for piercing through said plastic outer shell and into said core.

2. The marking apparatus according to claim 1 wherein said means for removably securing said pipe to said fire hydrant or other utilities fixtures comprises a plate secured to said pipe and having an aperture for attachment to the outlet of a fire hydrant.

3. The marking apparatus according to claim 1 wherein said means for removably securing said pipe to said fire hydrant or other utilities fixtures comprises fastening means adapted for securement to a threaded hole in a transformer box which receives a transformer lifting bolt.

4. The marking apparatus according to claim 1 wherein said means for removably securing to said pipe to said fire hydrant or other utilities fixture comprises fastening means adapted for securement to a lifting bracket of a transformer box.

5. The marking apparatus according to claim 1 wherein said mast-holding bracket is secured to a concrete base.

6. A marking apparatus according to claim 1 wherein said solid core of said elongated mast is made from a pultruded fiberglass.

7. A marking apparatus according to claim 6 wherein said flexible cylindrical outer shell for mounting on the core is made from a plastics material with a bright color.

8. A marking apparatus according to claim 1 wherein said indicator means comprises a panel of reflective material attached to the upper end of said elongated mast.

9. The marking apparatus according to claim 1 wherein said fastening means for securing said mast to said pipe comprises a piercing bolt extending through said pipe and plastic outer shell into said core.

10. The marking apparatus according to claim 1 wherein said hollow pipe is provided adjacent a lower end thereof with flexible tying means for securing to said hollow pipe and tying around said fire hydrant.

* * * * *